United States Patent [19]

Bock

[11] 4,204,392

[45] May 27, 1980

[54] METHOD AND DEVICE FOR THE PRODUCTION OF A WRAPPED YARN

[75] Inventor: Erich Bock, Ingolstadt, Fed. Rep. of Germany

[73] Assignee: Schubert & Salzer, Ingolstadt, Fed. Rep. of Germany

[21] Appl. No.: 5,338

[22] Filed: Jan. 22, 1979

[30] Foreign Application Priority Data

Feb. 3, 1978 [DE] Fed. Rep. of Germany ..... 2804542

[51] Int. Cl.[2] ..... D02G 3/36; D01H 7/86

[52] U.S. Cl. ..... 57/18; 57/58.36

[58] Field of Search ..... 57/16–18, 57/6, 58.3, 58.36, 58.38

[56] References Cited

U.S. PATENT DOCUMENTS

| | | | |
|---|---|---|---|
| 1,233,593 | 7/1917 | MacFarlane | 57/58.3 X |
| 2,400,697 | 5/1946 | Lewis | 57/58.3 |
| 3,328,946 | 7/1967 | Schumann et al. | 57/18 |
| 3,478,506 | 11/1969 | Kawashima | 57/18 |
| 3,831,369 | 8/1974 | Northup et al. | 57/18 X |
| 3,834,143 | 9/1974 | Menegatto | 57/18 X |

*Primary Examiner*—John Petrakes

*Attorney, Agent, or Firm*—Bailey, Dority & Flint

[57] ABSTRACT

The invention relates to a method for producing a wrapped yarn which consists of a bundle of textile fibers essentially without twist wrapped spirally by a binding-thread wherein prior to wrapping, the bundle of textile fibers is false-twisted and is introduced together with a binding-thread into the hollow spindle of a wrapping member having a binding-thread bobbin and a device for carrying out the method.

6 Claims, 4 Drawing Figures

METHOD AND DEVICE FOR THE PRODUCTION OF A WRAPPED YARN

BACKGROUND OF THE INVENTION

A method for the production of a wrapped yarn is known (West German O/S 1 685 881=British Pat. No. 1,159,510=U.S. Pat. No. 3,478,506). By the false-twisting which is imparted to the bundle of textile fibers emerging from a pair of delivery rollers on its way to the hollow shaft of a wrapper member having a hollow spindle, the bundle of textile fibers obtains a sufficiently great strength before wrapping so that breakages are avoided. The hollow spindle can therefore have a greater distance from the delivery rollers as compared to other known methods and devices in which the bundle of textile fibers remains without twist and the inlet opening to the hollow spindle is arranged at a distance corresponding with the average length of the staple fibers (U.S. Pat. Nos. 3,328,946 and 3,831,369). This facilitates attendance and avoids adaptation of the distance to the length of fiber at the time.

The productive capacity in the production of such a wrapped yarn is restricted by the speed of rotation of the hollow spindle to which the speed of delivery from the delivery rollers and the draw-off speed of the draw-off rollers must be adapted if a predetermined number of wraps per unit length are to be applied to the bundle of textile fibers.

It has been previously proposed to wrap an internal thread with two covering threads which run off two bobbins arranged one behind the other on a hollow spindle and rotate with it (West German Pat. No. 2,359,435). It is thereby possible to double the production. However, the outlay in material necessary to do this and the power requirement for the operation of the device are considerable.

The object of the present invention is to create a method and a device which avoids the aforesaid disadvantages and enables the simplified production of a wrapped yarn at a higher speed of production.

SUMMARY OF THE INVENTION

It has been found in accordance with the invention that increased production of a wrapped yarn can be had by introducing a bundle of textile fibers in the false-twisted state into the hollow spindle of a wrapper member wherein the yarn is led sideways out of it and carried past the binding-thread bobbin and after that deflected into the hollow spindle again. Whereupon the bundle of textile fibers and the binding-thread now fed to it pass through the hollow spindle in a direction counter to the first direction of pass of the bundle of textile fibers and as a wrapped yarn are led with a deflection sideways out of the wrapper member and drawn off, so that the binding-thread at each revolution of the wrapper member is wound twice round the bundle of textile fibers.

It is thereby now possible, in accordance with the invention, to double the delivery speed of the bundle of textile fibers at a predetermined number of wraps per unit length without the speed of rotation of the wrapping device having to be altered or an additional binding-thread bobbin having to be placed in front.

A device for carrying out the method includes a pair of delivery rollers, a pair of draw-off rollers and a wrapper member arranged between them having a hollow spindle and a hollow-shafted bobbin containing a binding-thread arranged coaxially with the hollow spindle wherein the hollow spindle includes two openings separate from one another which lie between the pair of delivery rollers and the bobbin containing the binding-thread. One of the openings is the outlet opening for the false-twisted bundle of textile fibers and the other opening provides the outlet opening for the wrapped yarn.

BRIEF DESCRIPTION OF THE DRAWINGS

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
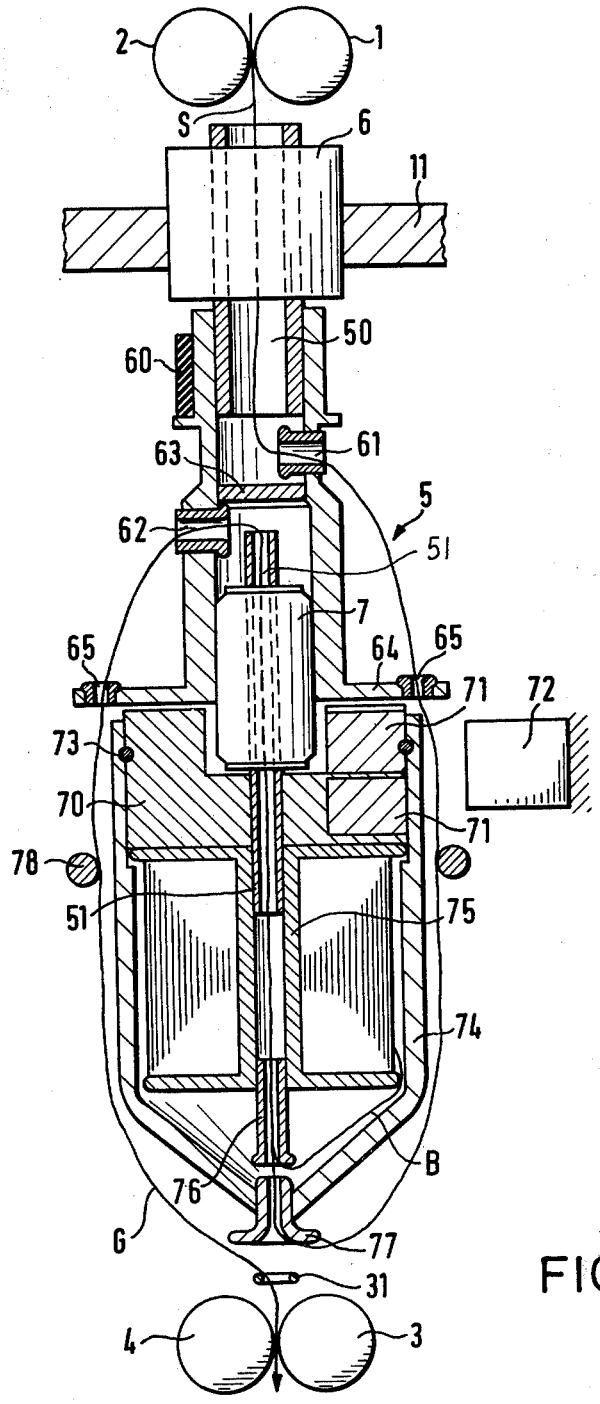
FIG. 1 is a longitudinal sectional view illustrating a yarn wrapping device constructed according to the invention having a two-part hollow spindle and side-openings.

Between a pair of delivery rollers 1, 2 and a pair of draw-off rollers 3, 4 a wrapper member is arranged which contains a hollow spindle shown generally as 5 (FIG. 1). The hollow spindle 5 consists of two spindle sections or spindle parts 50 and 51. The spindle part 50 is supported for rotation by means of a bearing 6 in the machine frame 11 and is driven by a tangential belt 60.

The driven spindle part 50 of the hollow spindle 5 has two side openings 61 and 62 which advantageously are arranged offset from one another on opposite sides in the shell of the spindle part 50. The opening 61 serves as outlet opening for the bundle of textile fibers S delivered by the delivery rollers into the spindle part 50 of the hollow spindle 5 and false-twisted, and the opening 62 serves as outlet opening for the wrapped yarn G as is explained in greater detail again later. In order to avoid a collision between the two threads a separator plate 63 is fastened inside the spindle 50, which separates the two openings 61 and 62 from one another.

The free end of the spindle part 50 is made as a spindle plate 64 which near to its edge has openings 65 for the bundle of textile fibers S and the wrapped yarn G to pass through. In accordance with FIG. 1 the component exhibiting the openings 61 and 62 and the spindle plate 64 is manufactured separately and connected fixedly in rotation to a spindle tube of spindle part 50. A one-piece form of the spindle part 50 may also be provided.

The spindle part 51 of the hollow spindle 5 connected to the spindle part 50 and projecting into it is rotatably supported in the spindle part 50 by means of a bearing 7. On the spindle part 51 is arranged a ring 70 of non-magnetic material with ferromagnetic inserts 71 upon which acts a stationary magnet 72. Rotation of the spindle part 51 with the driven spindle part 50 is thereby prevented.

A separator 74 in the form of a bell is fastened detachably to the ring 70 by means of clamp fastenings 73 and carries a flanged bobbin containing the binding-thread B and designated below as the binding-thread bobbin 75. The spindle part 51 of the hollow spindle 5 projects into the hollow shaft of the bobbin 75. Hence the binding-thread bobbin 75, supported and hanging in the separator 74, remains stationary during the rotation of the spindle part 50 just like the spindle part 51. A bobbin crown 76 is advantageously inserted into the free end of the hollow shaft of the binding-thread bobbin 75 having an opening for the bundle of textile fibers S and the binding thread B to pass through. During operation of the device, the separator 74 prevents contact of the bundle of textile fibers S and the wrapped yarn G with the binding-thread bobbin 75. The separator 74 has an opening formed as an eye 77 for the bundle of textile fibers S to pass through, which lies on the prolongation of the longitudinal axis of the two-part hollow spindle 5, the binding-thread bobbin 75 arranged coaxially therewith and the bobbin crown 76 inserted therein.

Figure 2:
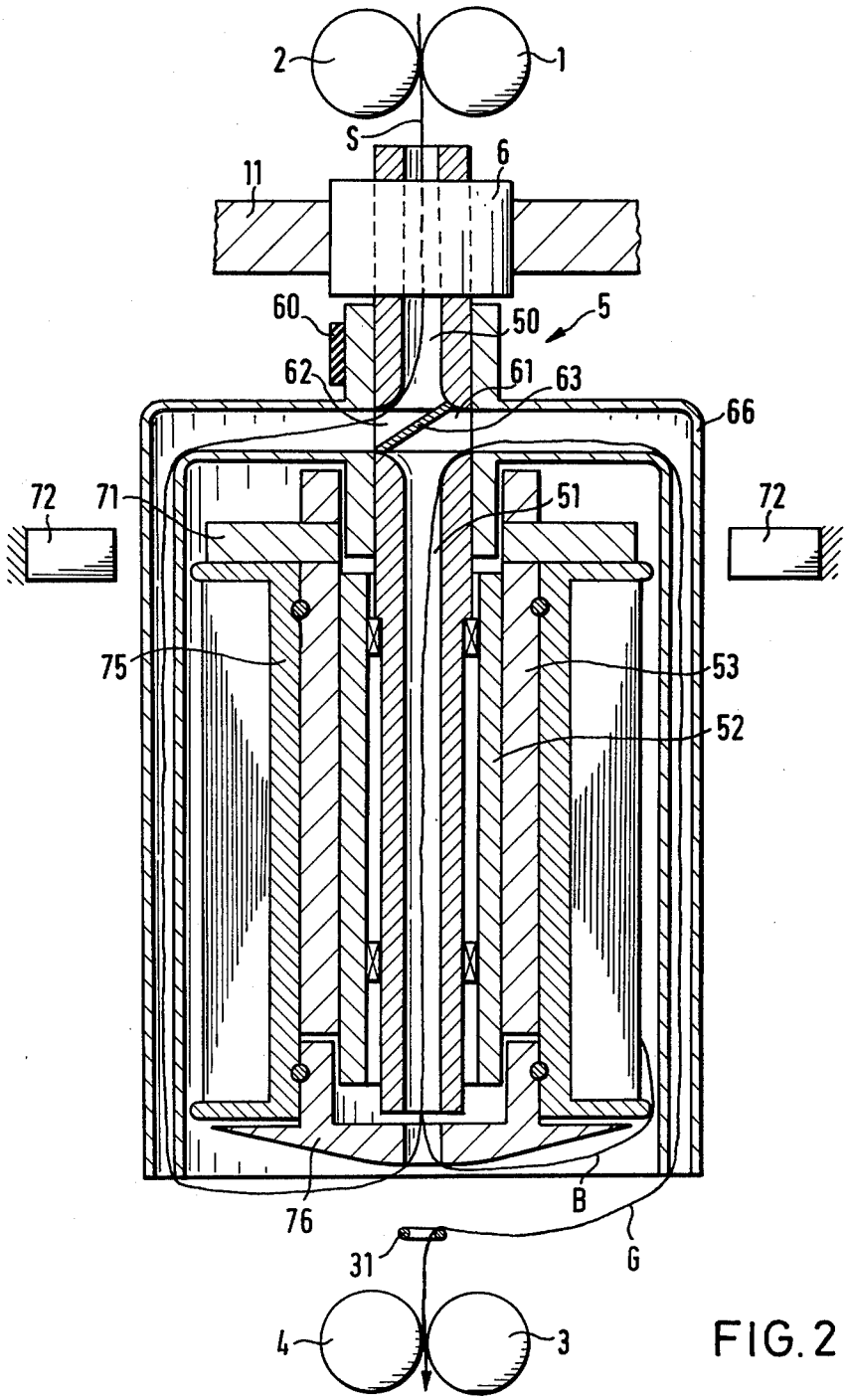
FIG. 2 is a longitudinal sectional view illustrating a yarn wrapping device having a bell as the guide member.

Between the wrapper member, which comprises the hollow spindle 5 and the binding-thread bobbin 75 arranged thereon, and the pair of draw-off rollers 3, 4, is a yarn guide eye 31 fastened to the machine frame. A roller mechanism of known construction (not shown) for the finished wrapped yarn G is arranged after the pair of draw-off rolls 3, 4. The separator 74 may also be omitted if necessary. In this case, for example, a flanged bobbin of ferromagnetic material containing the binding-thread B is employed and this is secured at the ring 72 as is shown in FIG. 2. The arrangement of the spindle plate 64 may also be eliminated in alternate embodiments of the invention.

The method which can be performed with the device in accordance with FIG. 1 for the production of a wrapped yarn will now be described. The course of the thread is explained first of all, which is determined essentially by the openings 61 and 62 arranged between the delivery rollers 1, 2 and the binding-thread bobbin 75 and respectively the two bearings 6 and 7 of the spindle parts 50 and 51.

The bundle of textile fibers S emerging from the pair of delivery rollers 1, 2, the thickness of which depends upon the yarn count to be produced, is introduced into the spindle part 50 of the hollow spindle 5 and brought out of the spindle part 50 again through the opening 61 with a deflection. After passing through the opening 65 in the spindle plate 64 the bundle of textile fibers S runs outside the separator 74, surrounding the binding-thread bobbin 75 like a bell, to eye 77 where it is deflected for entry into the hollow shaft of the binding-thread bobbin 75 as well as into the spindle part 51 and hence into a direction counter to the direction of its course hitherto.

At the inlet point of the bundle of textile fibers S into the hollow shaft of the binding-thread bobbin 75 which is extended by the bobbin crown 76, the binding-thread B which may be a filament, a yarn or a thread, is fed to the bundle of textile fibers S. Moreover, through the smooth guiding surface of the bobbin crown 76 a deflection low in friction of the binding-thread B into the hollow shaft of the binding-thread bobbin 75 is achieved. The bundle of textile fibers S and the binding-thread B pass through the hollow shaft of the binding-thread bobbin 75 and the spindle part 51 of the hollow spindle 5 and are next carried sideways out of the hollow spindle 5 through the opening 62 in the spindle part 50. At the opening 62 they are deflected in the direction towards the draw-off rollers 3, 4 which they reach after passing through the opening 65 in the spindle plate 64 and the yarn guide eye 31. Altogether the course of the yarn resembles a double loop starting from the opening 61, the middle part of which lies in the hollow shaft of the binding-thread bobbin 75 and of the spindle part 51 of the hollow spindle 5. The two outer loop parts one of which is formed by the false-twisted bundle of textile fibers and the other by the wrapped bundle of fibers, lie outside the wrapper member.

During the driving of the spindle part 50 of the hollow spindle 5 by the tangential belt 60 a false-twist is imparted to the bundle of textile fibers S emerging continuously from the delivery rollers 1, 2. This affords adequate strength for the bundle of fibers extending from the delivery rollers 1, 2 to the wrapping zone which starts at the feed point of the binding-thread B at the inlet into the hollow shaft of the binding-thread bobbin 75 or respectively the bobbin crown 76. In the further progress of its travel the bundle of textile fibers S, due to the aforesaid course of the yarn, is wrapped round spirally twice by the binding-thread B at each revolution of the spindle part 50. The finished wrapped yarn G is drawn off by the draw-off rollers 3, 4 through the opening 62 out of the wrapper member. Meanwhile the false-twist imparted to the bundle of textile fibers S gradually loosens so that finally a wrapped yarn G comes to be delivered, which consists of a bundle of textile fibers S wrapped by the binding-thread B, essentially without twist.

During the delivery of the bundle of textile fibers S into the wrapping zone and during draw-off of the wrapped yarn G from the wrapping zone, the bundle of textile fibers S and the wrapped yarn G form a thread balloon which completely encloses the spindle part 51 with the binding-thread bobbin 75 arranged on it. For reduction of the thread balloon a balloon-narrowing ring 78 may be advantageously fastened to the machine frame.

FIG. 2 shows an embodiment in which the spindle part 51 is connected rigidly to the spindle part 50 supported by means of the bearing 6 in the machine frame 11. The spindle part 51 carries a bearing 52 onto which a tubular spacer 53 is fixed by suitable means, for example, a press fit. To the spacer 53 are connected rigid inserts 71 of a ferromagnetic material which are associated with the stationary magnets 72. Further, the binding-thread bobbin 75 is clamped firmly onto the spacer 53 with the bobbin crown 76 preferably fitted to the bobbin 75.

In the embodiment of FIG. 2, a guide member for the bundle of textile fibers S and the wrapped yarn G is made as a bell 66 integral with the spindle part 50 of the hollow spindle 5. As illustrated, the component of the spindle part 50 and bell 66 are manufactured separately and connected integrally to the spindle tube of the spindle part by any suitable means, however, the spindle part 50 and bell 66 may also be made as one piece. The bell 66 includes an electrically non-conductive material and surrounds the binding-thread bobbin 75 completely. The bell includes holes drilled longitudinally for the bundle of textile fibers S to pass through on one side and the wrapped yarn G on the other side. The longitudinal holes are connected to the side-openings 61 and 62 in the spindle part 50 which are separated from one another by the separator plate 63. If necessary, instead of drilled holes a hollow shell may also be provided for the bell 66. Instead of the bell 66 a two-armed lobe having hollow lobe arms may equally well act as guide member for the bundle of textile fibers S and the wrapped yarn G.

During driving of the device by means of the tangential belt 60, the spindle part 50 with the bell 66 rotates in the bearing 6 and the spindle part 51 connected rigidly to the spindle part 50 rotates in the bearing 52. On the other hand, because of the action of the magnets 72 on the insert 71, the spacer 53 and hence also the bearing 52 fixedly connected to it, and the binding-thread bobbin 75 clamped firmly onto the spacer 53 remain stationary.

The course of the thread and hence also the method of production correspond essentially with that already described in connection with FIG. 1. The only difference being the opening 62 in the shell of the spindle part 50 has here been chosen the outlet as the opening for the false-twisted bundle of textile fibers S from the hollow spindle 5. After emergence from the opening 62, into which it is deflected, the bundle of textile fibers is guided by the drilled hole in the shell of the bell 66 or by its hollow shell. The bundle of textile fibers S emerging from the shell of the bell 66 is deflected via the bobbin crown 76 into the hollow shaft of the spindle part 51 of the hollow spindle 5, where it is joined by the binding-thread B running down from the stationary binding-thread bobbin 75. The bundle of fibers runs with the binding-thread through the spindle part 51 in a direction counter to its first direction of course and is drawn off by means of the draw-off rollers 3, 4 (FIG. 1) through the opening 61 sideways out of the hollow shaft and is deflected in the shell of the bell 66 and out of the latter through the yarn guide eye 31. Hence, at each revolution of the wrapper member the binding-thread B is wound twice round the bundle of textile fibers S in the wrapping zone and the false-twist imparted to the bundle of textile fibers S between the delivery rollers and the point of deflection at the bobbin crown 76 in the hollow shaft of the spindle part 51 is loosened again.

Figure 3:
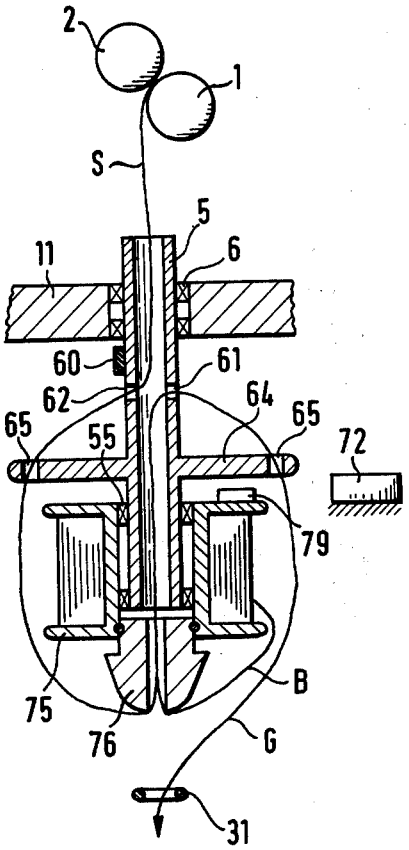
FIG. 3 is a longitudinal sectional view illustrating an alternate embodiment of a yarn wrapping device according to the invention.
Figure 4:
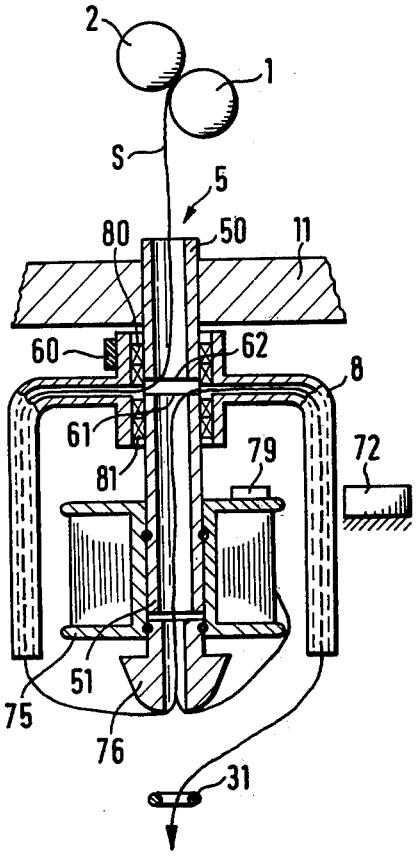
FIG. 4 is a longitudinal sectional view illustrating an alternate embodiment of a yarn wrapping device according to the invention.

FIGS. 3 and 4 show further embodiments of a wrapper device which enable the above-described yarn course in the form of a double loop and winding of the binding-thread twice round the bundle of textile fibers S at each revolution of the wrapper member.

In FIG. 3 the hollow spindle 5 is constructed as one piece. The hollow spindle 5 is supported for rotation by means of the bearing 6 in the machine frame 11 and is driven by the tangential belt 60. The spindle 5 carries a bearing 55 by which the binding-thread bobbin 75 is supported with the bobbin crown 76 inserted in its hollow shaft. The binding-thread bobbin 75 is advantageously a flanged bobbin, and is prevented from rotation by the stationary magnet 72 which acts upon a part 79 of the ferromagnetic material, affixed to the bobbin disk of the binding-thread bobbin 75. Openings 61 and 62 are arranged in the shell of the hollow spindle 5 between the delivery rollers 1, 2 and the binding-thread bobbin 75 or respectively between the two bearings 6 and 55. The opening 62 serves as the outlet opening for the false-twisted bundle of textile fibers S and the opening 61 as the outlet opening for the wrapped bundle of textile fibers or wrapped yarn G. After emergence from their respective openings the bundles S and G are guided through the spindle plate 64 by the openings 65.

In the case of the embodiment of FIG. 4 the hollow spindle 5 again includes two spindle parts 50 and 51 with the spindle part 50 connected rigidly to the machine frame 11. A two-armed lobe 8 with hollow lobe arms is supported for rotation on the spindle part 50 by means of a bearing 80. The spindle part 51 is fastened rotatably to the lobe 8 in a second bearing 81 in such a manner that there is a gap between the two spindle parts 50 and 51. The binding-thread bobbin 75, having the bobbin crown 76 arranged in its hollow shaft, is fixed to the spindle part 51. As the lobe 8 is driven by the tangential belt 60 rotation of the spindle part 51 and the binding-thread bobbin 75 is prevented by the stationary magnet 72 in combination with the part 79 on the bobbin disk of the binding thread bobbin 75.

Due to the spaced apart arrangement of spindle parts 50 and 51, side openings in the spindle shell are not necessary. The bundle of textile fibers S is delivered continuously from the delivery rollers 1, 2 and provided with false-twist during driving of the lobe 8. The bundle S is deflected sideways into the hollow arm of lobe 8 at its outlet from the free end of the spindle part 50. The bundle of textile fibers wrapped by the binding-thread B is deflected into the second hollow arm of lobe 8 at its outlet from the free end of the spindle part 51 and is drawn off and out of the latter through the yarn guide eye 31 as wrapped yarn G. Instead of a lobe, if necessary, a bell in accordance with FIG. 2 may also be provided.

The method described above for the production of a wrapped yarn may also be employed for the production of a thread, if, instead of the bundle of textile fibers S a yarn, a filament or a thread is delivered from the pair of delivery rollers into the hollow spindle.

While a preferred embodiment of the invention has been described using specific terms, such description is for illustrative purposes only, and it is to be understood that changes and variations may be made without departing from the spirit or scope of the following claims.

What is claimed is:

1. A method of producing a wrapped yarn of the type having a bundle of textile fibers essentially without twist wrapped spirally by a binding-thread, wherein the delivered bundle of textile fibers is false-twisted before the wrapping and is introduced together with the binding-thread into the hollow spindle of a wrapper member having a binding-thread bobbin, and the wrapped yarn is subsequently drawn out of the wrapper member, said method comprising:

introducing the yarn in the false-twisted state into the hollow spindle of said wrapper member;

leading said yarn sideways out of said hollow spindle and in a first direction past the binding-thread bobbin;

deflecting said yarn into said hollow spindle again;

passing said yarn and said binding-thread through the hollow spindle in a direction counter to said first direction of pass of said yarn;

providing a wrapper member causing said binding-thread to be wrapped around said yarn;

leading said wrapped yarn sideways out of said hollow spindle and drawing said wrapped yarn from said hollow spindle in said first direction so that the binding-thread at each revolution of the wrapper member is wrapped twice around said yarn.

2. A device for producing a wrapped yarn of the type having a pair of delivery rollers, a pair of draw-off rollers, and a wrapper member arranged between said delivery and draw-off rollers, wherein said wrapper member comprises:

a hollow spindle and a hollow-shafted bobbin containing a binding-thread arranged coaxially with the hollow spindle;

said hollow spindle including two openings separate from one another which are disposed between said pair of delivery rollers and said bobbin containing the binding-thread;

one of said openings being an outlet opening through which the yarn passes prior to being wrapped; and the other of said openings being an outlet opening through which the wrapped yarn passes.

3. A device as in claim 2 including a separating plate arranged between said two openings in the hollow spindle.

4. A device as in claim 2 wherein said hollow spindle includes two spindle parts, one of said spindle parts carrying said binding-thread bobbin upon which said binding-thread is wound in a stationary manner.

5. A device as in claim 4 wherein said two spindle parts of said hollow spindle are arranged at a distance apart and are stationary, one of said spindle parts being connected rigidly to a machine frame, and wherein said device includes a rotating guide member surrounding the binding-thread bobbin for guiding said yarn before and after wrapping.

6. A device as in claim 4 wherein said two spindle parts are rigidly connected together, said openings being formed in a first of said spindle parts, and wherein said device includes a guide member for said yarn and said wrapped yarn carried on at least one of said spindle parts which rotates with said spindle parts while said binding-thread bobbin is stationary.

* * * * *